US006861029B2

(12) United States Patent
Menk et al.

(10) Patent No.: US 6,861,029 B2
(45) Date of Patent: Mar. 1, 2005

(54) NODULAR CAST IRON ALLOY

(75) Inventors: Werner Menk, Schaffhausen (CH); Dirk Lindemann, Hohenfels (DE); Dirk Richarz, Bodman-Ludwigshafen (DE)

(73) Assignee: Georg Fischer Fahrzeugtechnik AG, Schaffhausen (CH)

( * ) Notice: Subject to any disclaimer, the term of this patent is extended or adjusted under 35 U.S.C. 154(b) by 0 days.

(21) Appl. No.: 10/176,434

(22) Filed: Jun. 20, 2002

(65) Prior Publication Data

US 2002/0195180 A1 Dec. 26, 2002

(30) Foreign Application Priority Data

Jun. 20, 2001 (DE) ..... 101 29 382

(51) Int. Cl.[7] ..... C22C 37/04

(52) U.S. Cl. ..... 420/14; 420/9; 148/324; 148/321

(58) Field of Search ..... 420/10–17; 148/324, 148/321

(56) References Cited

FOREIGN PATENT DOCUMENTS

| | | |
|---|---|---|
| DE | 24 28 822 | 1/1976 |
| DE | 100 29 062 | 3/2001 |

OTHER PUBLICATIONS

English abstract of Soviet Union patent 1528806, Dec. 15, 1989.*

English abstract of European patent 80590A, published Jun. 8, 1983.*

English abstract of European patent 80590 B, published May 28, 1986.*

English abstract of Soviet Union patent 524852 published Nov. 19, 1976.*

English abstract of Canadian patent 1167164 published Dec. 10, 1997.*

* cited by examiner

*Primary Examiner*—Deborah Yee
(74) *Attorney, Agent, or Firm*—Bachman & LaPointe, P.C.

(57) ABSTRACT

A modified nodular cast iron alloy contains positive additions of boron and silicon in a content of greater than 2.4% by wt.

6 Claims, 1 Drawing Sheet

NODULAR CAST IRON ALLOY

BACKGROUND OF THE INVENTION

The invention relates to a nodular cast iron alloy for cast iron products with plastic deformability, the nodular cast iron alloy containing, as non-ferrous constituents, at least the elements C, Si, Mn, Cu, Mg, S and, as admixtures, one or more elements selected from group IIIb of the periodic system (IUPAC form).

In the automotive sector, nodular cast iron alloys are used for the production of castings which have to be able to withstand a high impact load, for example wishbones, as parts of the suspension of the driven wheels which have to remain intact even after an accident. During what is known as the crash test, the castings may be deformed but must not break. Commercially available grey cast iron alloys tend to fracture if they are exposed to strong impacts.

WO 99 45 156 A1 has disclosed a process for producing nodular cast iron alloys with product inclusions which are deformed plastically during the machining of the products which are produced. The plastically deformable inclusions serve as lubricant during the machining. The inclusions consist of approximately 50% by wt. of $SiO_2$, 25% by wt. of CaO, 15% by wt. of go and 10% by wt. of $Al_2O_3$. The base alloy is made to have a low sulphur and oxygen content prior to the actual treatment with magnesium, by means of a reagent which includes $CaC_2$, CaO, Ca, Al and Mg. A metallurgical analysis of the products produced in this way is not disclosed.

Working on the basis of the prior art, it is an object of the invention to provide a nodular cast iron alloy for cast iron products with plastic deformability which is significantly higher than that of commercially available nodular cast iron alloys even in the event of a high impact load.

SUMMARY OF THE INVENTION

The foregoing object is achieved by a nodular cast iron alloy for cast iron products with plastic deformability, the nodular cast iron alloy containing, as non-ferrous constituents, at least the elements C, Si, Mn, Cu, Mg, S and, as admixtures, one or more elements selected from group IIIb of the periodic system (IUPAC form), in which alloy the alloy includes, as admixture, at least the element boron, and wherein the Si content of the alloy is greater than 2.4% by wt.

DETAILED DESCRIPTION

Figure 1:
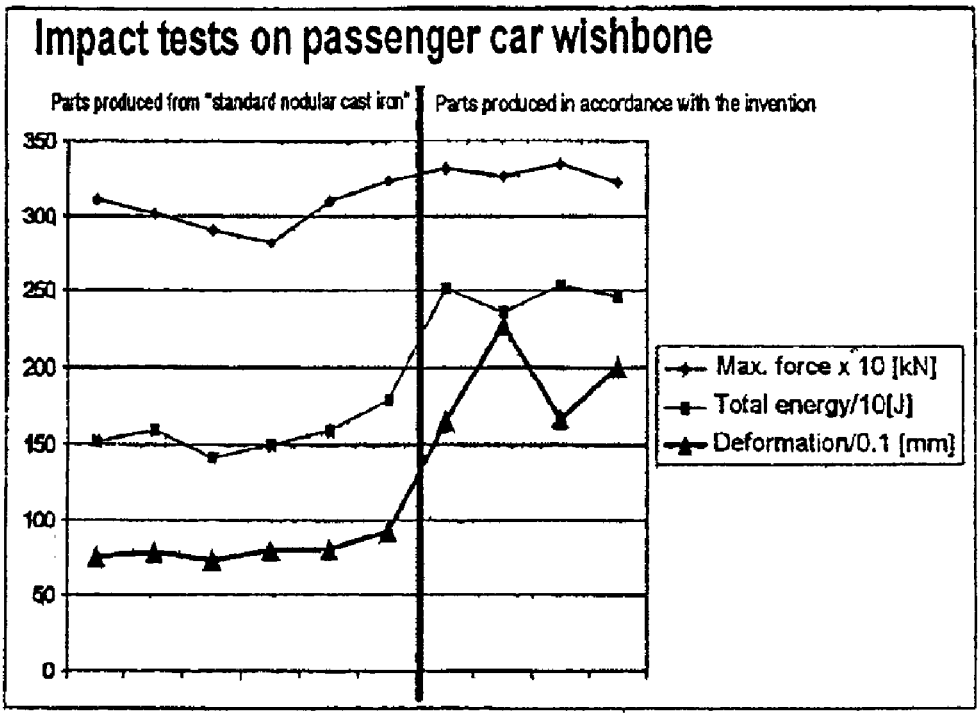
FIG. 1 shows the results of impact tests carried out on a wishbone of a passenger vehicle comparing the alloy of the present invention to the prior art.

In accordance with the present invention it is advantageous that the pearlite content in the microstructure of the cast iron products is reduced and that a ferritic microstructure can be ensured. This is achieved by the fact that the alloy contains 2 to 200 ppm of the admixture, preferably 10 to 100 ppm and ideally 60 to 200 ppm. The admixture must include boron and, accordingly, if boron is used in combination with another Group IIIb element, boron should be present in an amount of 60 ppm or greater, with the balance of 140 ppm being one or more of the Group IIIb elements. If no other Group IIIb element is used in the admixture, then the entire range of 2 to 200 ppm, preferably 10 to 200 ppm, ideally 60 to 200 ppm, would be boron. It is preferred that boron be present in at least about 60 ppm. A preferred admixture comprises boron and aluminum wherein each is present in an amount of between 80 to 120 ppm with the total amount preferably less than or equal to 200 ppm.

It is also advantageous that the solid solutions can be strengthened in the microstructure of the cast iron products. This is achieved by the fact that the Si content is present in an amount of greater than the 2.4% by wt., preferably between 2.6 to 2.9% by wt.

It is also advantageous that, during the further treatment of the surfaces of the cast iron products, the minimum possible level of internal stresses are generated in the cast iron products. This is achieved by subjecting the cast iron products to a further treatment, which is particularly gentle to the product surfaces, after the casting process. This is also achieved by the fact that the gentle further treatment of the surfaces comprises stress-relief annealing and/or blasting with weakly abrasive particles. The further treatment of the surfaces, which usually takes place during the process step known as fettling after the castings have been removed from the casting mould and after cooling, may cause internal stresses to build up in the casting, and these internal stresses may subsequently initiate a fracture in the casting. Carrying out the surface treatment as gently as possible means that the minimum possible level of internal stress is built up in the casting, and the risk of a fracture is greatly reduced.

The basic idea of the invention is to provide a cast iron alloy which is particularly suitable for load-bearing parts, for example for the suspension system employed in the automotive industry. The load-bearing parts must not break, but rather must merely be deformed. The deformation is to be plastic rather than elastic. The deformability of the parts is to be plastic and as great as possible, should not lead to the parts breaking and should not be reversible.

EXAMPLE 1

A wishbone for a suspension of a front wheel of a passenger car made from modified nodular cast iron (GJS-400-15) having the following chemical composition: 3.5% by wt. C, 2.7% by wt. Si, 0.16% by wt. Mn, 0.06% by wt. Cu, 0.043% by wt. Mg, 0.002% by wt. S, 200 ppm total of the elements from group IIIb of the periodic system (B, Al, Ga, In, TL) where B is present in an amount of 100 ppm, Al is present in an amount of 90 ppm and other Group IIIb element(s) is(are) present in an amount of 10 ppm. The resulting microstructure contains at most 15% by wt. of pearlite.

The formation of graphite in the microstructure, measured in accordance with DIN EN ISO 945, amounts to more than 90% by wt. form VI, and the size of the nodules of graphite in the microstructure belongs to Classes 7–8.

The mechanical properties of this casting are given as $R_{p0.2}$ at least 250 N/mm$^2$, $R_m$ at least 400 N/mm$^2$ and A at least 15.0% by wt.

The composition and properties of the casting are compared with a conventional nodular cast iron alloy of designation GJS-400-15. This alloy has the following composition range:

Carbon 3.4 to 3.8% by wt.

Silicium 1.0 to 3.0% by wt.

Manganese less than 0.3% by wt.

Copper less than 0.1% by wt.

Magnesium 0.025 to 0.05% by wt.

Sulphur less than 0.015% by wt.

Balance essentially iron, and impurities in trace amounts

There is no positive additive of B or other Group IIIb metal.

The effectiveness of the composition of the present invention can be demonstrated on the basis of the measurement results from an instrumented impact test. The impact test is carried out as a simulation of the misuse test of the suspension of the passenger car.

The test is aimed at establishing whether the suspension still supports the passenger car after a collision sufficiently for it to be possible to drive the car to the closest workshop. Then, at the workshop, the bearing part of the suspension, for example the wishbone (lower control arm), which has been permanently and irreversibly deformed by the collision, but is still fracture-resistant and able to support the load, has to be replaced.

The right-hand side of FIG. 1 shows the measurement results of the Impact tests carried out on a wishbone of a passenger car. The left-hand side of FIG. 1 also presents the measurement results for an identical casting which has been produced from commercially available nodular cast iron, for comparison purposes. It can be seen from FIG. 1 that the total amount of energy absorbed in the wishbone in the impact test is more than 2200 J. It can also be seen from FIG. 1 that the deformation in the impact test is more than 75% by wt. higher than for a comparable casting made from a conventional nodular cast iron. The deformation of the wishbone, expressed in mm, measured as the difference between two measurement points on the casting before and after the impact test, is more than 15 mm. For comparable castings made from a conventional nodular cast iron alloy, this deformation is usually less than 9 mm. The maximum force which is absorbed by the wishbone is between 3000 and 3500 kN. The instrumented impact test is in this case carried out on a Rosand Impact Tester.

Wishbones for a passenger car which are produced from the nodular cast iron alloy according to the invention, with an Si content of at least 2.4% by wt. and including at least the element boron as admixture, which have been subjected to a surface treatment which is as gentle as possible during the fettling, are distinguished by a high plastic, irreversible deformability. The bearing parts of the suspension of an automobile do not break during the crash test, which simulates a specific accident situation, and remain intact.

The present casting alloy is also suitable for all other vehicle components which, under extreme loads, may be deformed but must not fracture.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A nodular cast iron alloy for cast iron products characterized by plastic deformability, the nodular cast iron alloy consisting essentially of, as non-ferrous constituents, at least the elements C, Si, Mn, Cu, Mg, S and an admixture comprising at least two elements selected from group IIIb of the periodic system in an amount of between 60 to 200 ppm, wherein one element is B in an amount between 60 to 120 ppm and the other element is selected from the group consisting of at least one other Group IIIb element; and wherein the Si content is between 2.4 and 2.9% by wt., balance essentially Fe.

2. A nodular cast iron alloy for cast iron products with plastic deformability according to claim 1, wherein the Si content is 2.6 to 2.9% by wt.

3. A nodular cast iron alloy for cast iron products with plastic deformability according to claim 1, wherein the plastic deformation of the products after an instrumented impact test is irreversible and permanent.

4. A nodular cast iron alloy for cast iron products with plastic deformability according to claim 3, wherein the energy absorbed by the products in the instrumented impact test is at least 35% by wt. higher than for similar cast iron products made from conventional nodular cast iron alloys (GJS-400-15), and are fracture-resistant.

5. A process for producing cast iron products from a nodular cast iron alloy with plastic deformability according to claim 1, wherein the surfaces of the cast iron products are subjected to stress-relief annealing or blasting with abrasive particles.

6. An automobile wishbone cast iron product made from the alloy of claim 1.

* * * * *